US005558499A

United States Patent [19]

Kobayashi

[11] Patent Number: 5,558,499

[45] Date of Patent: Sep. 24, 1996

[54] CENTRIFUGAL BLOWER WHEEL WITH BACKWARD CURVED BLADES

[76] Inventor: Takao Kobayashi, No. 15-16, Momohamacho, Hiratsuka-shi, Kanagawa-ken, Japan

[21] Appl. No.: 317,625

[22] Filed: Oct. 3, 1994

[30] Foreign Application Priority Data

Oct. 6, 1993 [JP] Japan ..... 5-272934

[51] Int. Cl.[6] ..... F04D 29/30

[52] U.S. Cl. ..... 416/186 R; 416/241 A; 416/229 R

[58] Field of Search ..... 416/186 R, 188, 416/241, 226, 228, 229 R

[56] References Cited

U.S. PATENT DOCUMENTS

| | | | |
|---|---|---|---|
| 2,054,144 | 9/1936 | Swigert | 416/188 |
| 3,144,204 | 8/1964 | Bohanon | 416/186 R |
| 3,901,625 | 8/1975 | Witzel | 416/241 A |
| 4,231,706 | 11/1980 | Ueda et al. | 415/186 |
| 4,253,796 | 3/1981 | Philipps et al. | 415/157 |
| 4,957,414 | 9/1990 | Willingham | 416/241 A |
| 5,328,332 | 7/1994 | Chiang | 416/186 R |

FOREIGN PATENT DOCUMENTS

| | | | |
|---|---|---|---|
| 64-41697 | 3/1969 | Japan . | |
| 0070094 | 4/1983 | Japan | 416/241 A |
| 0190499 | 10/1984 | Japan | 416/186 R |
| 0088898 | 5/1985 | Japan | 416/186 R |
| 62-136471 | 1/1987 | Japan . | |
| 3029098 | 2/1988 | Japan | 416/229 R |
| 2042093 | 9/1980 | United Kingdom | 416/226 |

*Primary Examiner*—Edward K. Look
*Assistant Examiner*—Mark Sgantizos
*Attorney, Agent, or Firm*—Rossi & Associates

[57] ABSTRACT

According to this invention, there is provided a centrifugal blower wheel with backward curved comprising a disk, a shroud and a plurality of airfoil shaped blades. By separating the blades into "vane members" which assume the function of a fluid device and "vane attachment members" which assume the function of a rotating device, there is a greater degree of freedom of design, so optimum materials and shapes can be assigned to these different functions. The disk, the shroud and the vane attachment members are therefore constructed of metal and provided with beads so as to give a highly rigid structure, while the vane members are constructed of non-metal. This makes it possible to provide a blower wheel which is more lightweight and quieter in operation than a conventional blower wheel.

6 Claims, 5 Drawing Sheets

CENTRIFUGAL BLOWER WHEEL WITH BACKWARD CURVED BLADES

BACKGROUND OF THE INVENTION

1. Field of the Invention

This invention relates to the structure of a centrifugal blower wheel with backward curved blades, and more specifically concerns a wheel with blades having airfoil cross sectional shapes. This type of centrifugal blower is used in exhausting, ventilating and air conditioning devices.

2. Prior Art

It is well known that the centrifugal blower wheel (hereinafter referred to as wheel) with airfoil shaped blades (hereinafter referred to as blades), is highly efficient and low in noise.

This type of wheel comprises a shroud, a disk and blades. Conventional wheels are classified, roughly, into three types based on the difference of material and manufacturing method. Hereinafter, these wheels will be referred to as type A wheel, type B wheel and type C wheel.

The type A wheel comprises the airfoil blades which are made of steel or aluminum sheet by press working, and the shroud and the disk which are made of the same metal as the blades. The blades are fixed to the shroud and the disk by means of caulking or the like. It is difficult to form the blades precisely into an airfoil shape by press working, therefore, the type A wheel is inferior to the other type wheels in efficiency, and higher in operating noise caused by air turbulence on the surface of the blades. Furthermore, metal has a high characteristic frequency, and thus higher operating noise. However, the type A wheel is the lightest in weight and the most rigid as a rotating device among these three types of wheels.

The type B wheel comprises the blades which are made of aluminum by extrusion molding, the shroud and the disk which are made of aluminum sheet. The blades are fixed to the shroud and the disk by means of welding or the like. Since the blade of this type wheel has the most accurate airfoil shape, the type B wheel is the most efficient but also the heaviest.

The type C wheel comprises the airfoil blades which are made of plastic material by injection molding, the shroud and the disk which are made of plastic material. The blades are fixed to the shroud and the disk by means of adhering or the like. The type C wheel is more efficient than the type B wheel and the quietest in operating noise among the aforementioned three types of wheels. However, the type B wheel can be deformed easily by heat.

As described above, all three types have their respective advantages and disadvantages, hence no blower wheel is completely satisfactory for all operating environments. Therefore, the type of wheel was chosen considering the blower operating environment.

Recently, more blowers for air conditioning devices have been required to operate with higher efficiency and less noise. At the same time, there is a need for greater compactness, which means the blower must be operated at even higher speeds. Thus, blower wheels have been required which have higher rigidity and dynamic balance in order to withstand the loads due to high speed running. Furthermore, in the case of air conditioning apparatus, more units are being installed in ceilings so as to enable more effective use of floor space. This creates a greater need for blowers to be more lightweight and quieter in operation. However, these requirements cannot be achieved absolutely by the aforementioned conventional wheel structures.

SUMMARY OF THE INVENTION

It is therefore an object of this invention to provide a wheel which is more lightweight than conventional blowers, which is quieter in operation, and which is more efficient.

Typically, a blower wheel is required to incorporate two different functions at the same time, namely, that of a rotating device (rigidity and dynamic balance), and that of a fluid device (efficiency and quiet operation). These two functions are mutually conflicting.

In order to increase rigidity as a function of a rotating device, it is expedient to provide beads on the surface of the blades, but as this causes fluid to separate away at the surface of blades, efficiency and operating noise as functions of a fluid device are remarkably impaired. Further, plastic is the most suitable material from the view point of reducing the operating noise as a function of a fluid device, but rigidity as a function of a rotating device is impaired.

In conventional wheel design, attempts were made to satisfy these two conflicting functions at the same time, but they were not successful.

According to this invention, these two functions, namely that of a vane as a fluid device, and that of a rotor as a rotating device, are analyzed in depth, and then integrated into a composite function. This novel design concept has solved the aforementioned conflicting requirement and given an ideal blower wheel construction.

The design procedure of this invention will be described as follows.

First, the rotor as a rotating device is designed.

(1) The type A wheel, which has the best as a rotating device, is chosen for the basic structure of the rotor.

(2) Each airfoil blade, which is expected to perform two conflicting functions at the same time in conventional wheel design, is considered separately as pertaining to a vane member as a fluid device, and a vane attachment member as a rotating device.

(3) The vane attachment member, which is formed from sheet metal, is provided with beads which were disallowed in the case of fluid device. These beads increase the rigidity of the vane attachment member. If there is no need to increase rigidity, then it is possible to reduce the thickness and weight of the vane attachment member.

A plurality of tabs are provided at both sides of the vane attachment member. Small holes are pierced at several positions in the vane attachment member so as to join completely to the vane member.

(4) A disk and a shroud are made from sheet metal, and provided with beads so as to increase rigidity. If there is no need to increase rigidity, then it is possible to reduce the thickness and weight of the disk and the shroud.

Long holes are provided in the disk and the shroud.

(5) The tabs of the vane attachment member are inserted into these long holes and caulked or welded so as to be fixed to the disk and the shroud.

(6) The most suitable material for the blower operating condition may be chosen as the material of this rotor.

Second, the vane as a fluid device is designed.

(1) Once the vane attachment member has the rotating device function, the vane member may be considered with regard to only the fluid device function. Therefore, designers can now design an optimally-shaped vane member using optimal materials (for example, plastics or ceramics) for the vane.

(2) A production method of the vane members are chosen according to production volumed for example extrusion molding, injection molding or compression molding.

(3) As the vane attachment members, which are made of metal, and the vane members, which are made of non-metal, have different thermal expansion coefficients, peeling easily occurs. Small holes are therefore pierced at several positions in the vane attachment members, and the vane members are completely adhered or welded together through these holes so as to prevent peeling.

Third, the rotor and the vane are assembled.

(1) The vane members are attached to the vane attachment members so as to cover them and form the blades. The tabs which are provided in the vane attachment members are inserted into the long holes which are pierced in the disk and the shroud, and then fixed by means of caulking, welding or blazing. Thus, a plurality of the blades join the disk and the shroud and the blower wheel according to this invention is obtained.

According to the invention described above, two conflicting functions, namely, the vane as a fluid device and the rotor as a rotating device, are separately analyzed. Accordingly, there is a greater degree of freedom of design. This makes it possible to provide a blower wheel which is more lightweight, quiet and efficient in operation and lower cost in manufacturing. Further, the blower is adaptable to any operating environment.

DESCRIPTION OF THE PREFERRED EMBODIMENTS

Embodiment 1

A preferred embodiment of this invention will now be described with reference to FIGS. 1–7.

Figure 7:
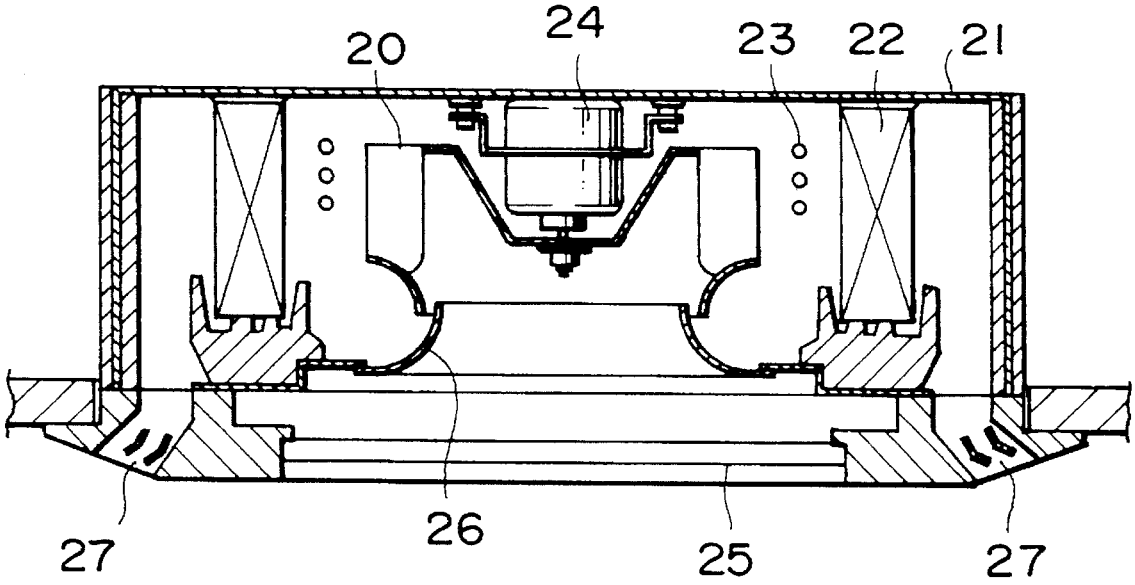
FIG. 7 is a cross-sectional end view of an air conditioning apparatus being installed in a ceiling.

This embodiment relates to an improvement of a wheel which is used in an air conditioning apparatus being installed in a ceiling, as shown in FIG. 7.

Requirements for the wheel 20 are as follows.

Requirement 1 is extreme low operating noise because the blower is installed near residents in a room.

Requirement 2 is heat resistance because a heater is arranged near the blower.

Requirement 3 is low weight because this apparatus is installed in a ceiling.

The type C wheel was most suitable for requirement 1, however, it was most unsuitable for requirement 2. The type B and the type C wheels were applicable to requirement 2. The type A wheel was most suitable for requirement 3, but, it was most unsuitable for requirement 1.

As described above, there was no wheel which was suitable for all requirements. Thus, the type B wheel was chosen as the second best wheel, but required more weight reduction. Japanese Utility Model Laid-Open No. 01 (1989)-41697 was devised, but does not achieve the required weight reduction.

The design and manufacturing procedure of the wheel by this invention will now be described with reference to FIG. 1 to FIG. 7.

(1) The type A wheel, which is the best as a rotating device, is chosen for the basic structure of the rotor.

(2) Each of airfoil blades 1, which is expected to perform two conflicting functions at the same time in conventional wheel design, are considered separately as pertaining to a vane member 2 as a fluid device, and a vane attachment member 3 as a rotating device.

(3) The vane attachment member 3 is made of metal sheet. Tabs 8 are provided at both sides of the vane attachment member 3, with more than three tabs in one side. Furthermore, beads 10 are provided on the vane attachment member 3 in order to increase rigidity. Small holes 11 are provided on the vane attachment member 3 to join to the vane member completely for preventing peeling.

(4) The disk 4 and the shroud 5 are made of metal sheet. Curled beads 30 are included on the circumference of the disk and the shroud to increase the rigidity. If there is no requirement to increase the rigidity, then it is possible to reduce the thickness and the weight of metal sheet.

Furthermore, long slots 9 are pierced in the disk 4 and the shroud 5, the tabs 8 are inserted into these slots 9 and fixed. In addition, if beads are provided on the disk 4 and the shroud 5 along the outline (not shown) of the vane member 2 to be used as a nest, this makes it possible to increase the rigidity of the wheel.

(5) Aluminum alloy sheet is chosen for the material of the vane attachment member 3 and the disk 4 and the shroud 5, thereby the design of the rotor is finished.

(6) As the second step, the vane member 2 is made of heat resistant plastic material by injection molding and covers the vane attachment member 3. And when the vane member 2 is attached to the vane attachment member 3, the airfoil blade 1 is obtained. For final assembly, the tabs 8 of the airfoil blades 1 are inserted into the slots 9 of the disk 4 and the shroud 5, and then, are bent and caulked so as to join the disk 4 and the shroud 5. The wheel 20 of this invention is thus obtained.

(7) For one other example of final assembly, i.e., when the wheel is required to operate under severe high speed, the tab 8 can be welded to the disk 4 and the shroud 5 after being caulked.

(8) For another attaching method of the vane member 2 to the vane attachment member 3, the vane attachment member 3 may be inserted into the inside of the vane member 2, which is formed by plastic extrusion molding and then is cut a length of the airfoil blade, and joined by means of adhering.

Optimal plastic material and manufacturing method of the vane member 2 are chosen in consideration of the blower operating condition and manufacturing volume and permissible cost.

In any case, the small holes 11 provided in the vane attachment member 3 operate effectively to prevent the peeling of the vane member 2 and the vane attachment member 3.

(9) As aero-dynamic characteristics and noise characteristics of the blower depend upon the shape and the material of the vane attachment member 2, requirements of high efficiency and low operating noise are achieved by the aforementioned structure of the wheel.

Figure 1:
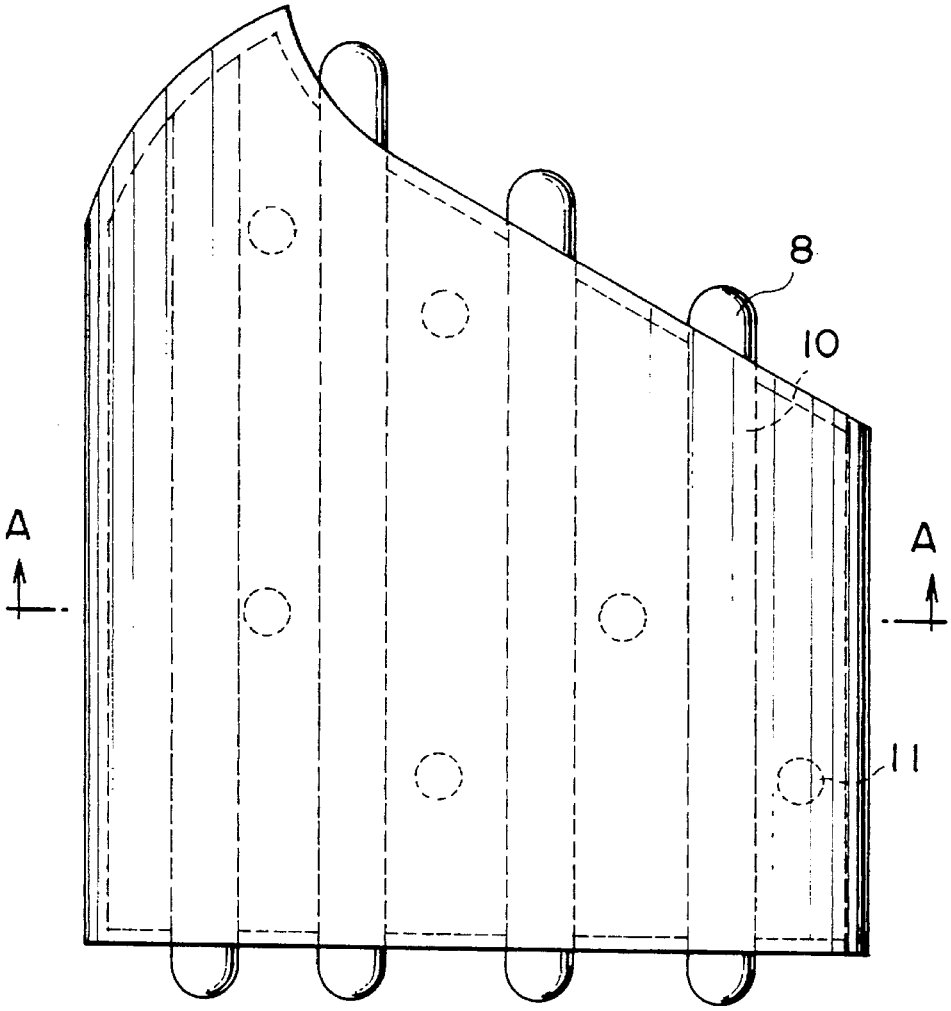
FIG. 1 is a plan view of an airfoil blade showing one embodiment of this invention.
Figure 2:
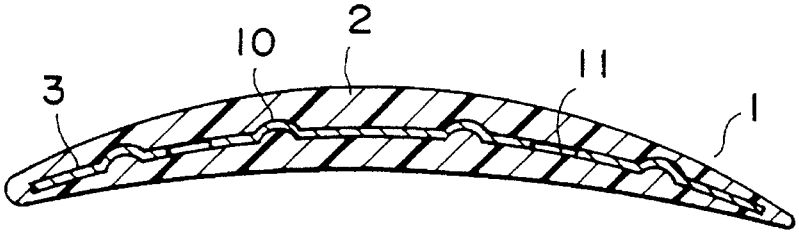
FIG. 2 is a cross-sectional view of the same.
Figure 3:
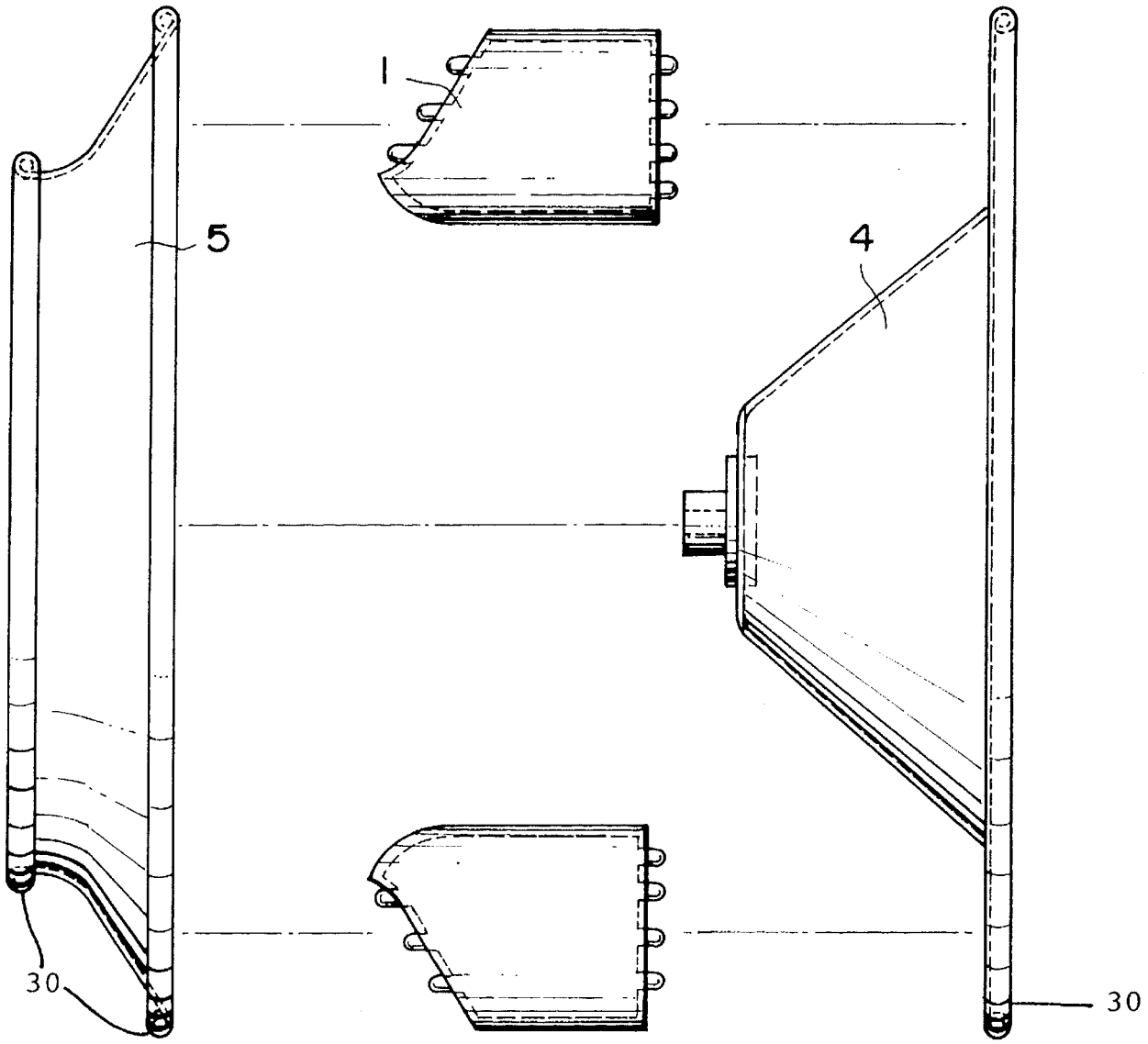
FIG. 3 is an end view of the airfoil blades, a disk and a shroud, showing an arrangement of blower parts of this invention.
Figure 4:
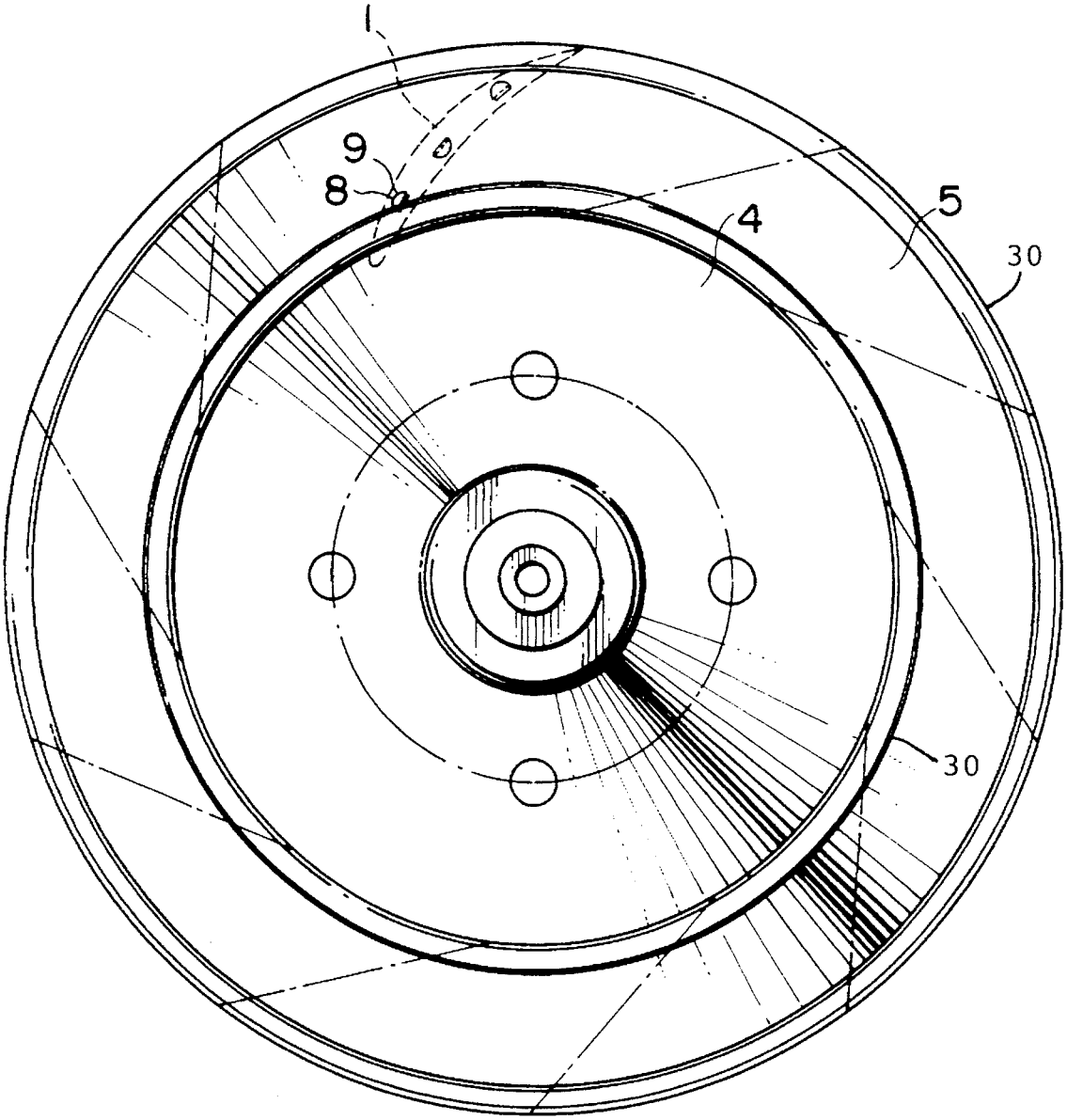
FIG. 4 is a plan view of a centrifugal blower wheel of this invention.
Figure 5:
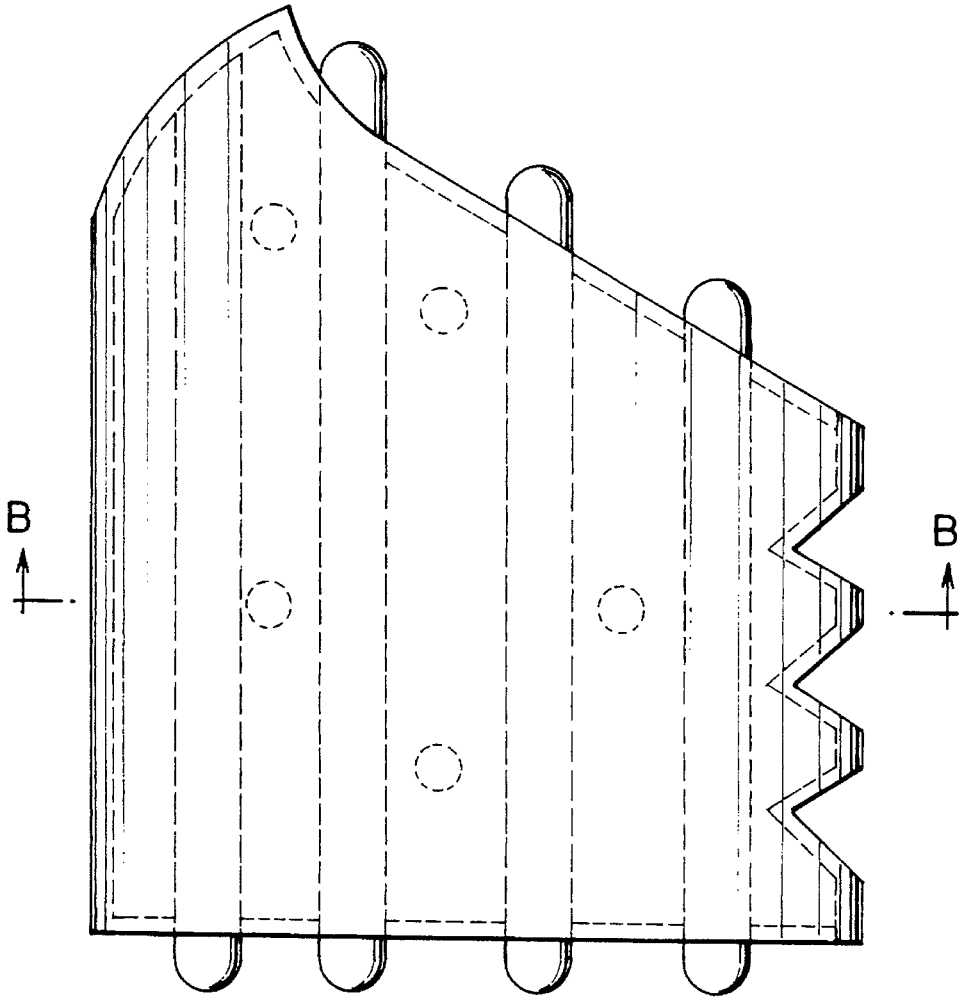
FIG. 5 is a plan view of an airfoil blade showing another embodiment of this invention.

For further requirement of quieter operating noise, the outside of the vane member is formed into a zigzag shape, as shown in FIG. 5. In this case, if the outside of the vane attachment member 3 is cut in a zigzag shape, the vane member will be more rigid near the end.

Figure 6:
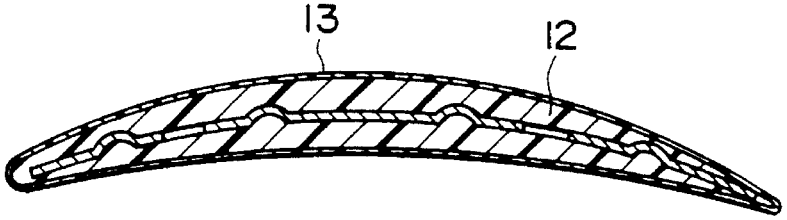
FIG. 6 is a cross-sectional end view of the airfoil blade showing a further embodiment of this invention.

(10) For further weight reduction, the vane member 2 is formed on the inside 12 with foaming type plastic, and is covered on the outside 13 by heat resistant plastic material, as shown in FIG. 6.

According to the invention as described above, the vane member is reinforced to near the end by the vane attachment member 3 thereby, the vane member is considered only with regard to its aerodynamic and noise characteristics without considering its strength and rigidity.

In embodiment 1, the wheel is reduced 18% in weight and 30% in cost in comparison with the type B wheel.

Embodiment 2

When gas is present as in the case of a chemical plant, aluminum alloy plate or stainless steel plate is used for the vane attachment member 3, the disk 4 and the shroud 5. In addition, plastic material is used for the vane member. In embodiment 2, the wheel is reduced 15% in weight and 30% in cost, in comparison with the type C wheel.

Embodiment 3

When hot gas is present, heat resistant stainless steel plate is used for the vane attachment members and the disk and the shroud, and a ceramic material is used for the vane members. In this embodiment 3, the wheel has reduced operating noise, and improved heat resistant characteristics in comparison with the type C wheel.

According to this invention described above, two conflicting functions, namely, the vane as a fluid device and the rotor as a rotating device, are separately analyzed. Thus, there is a greater degree of freedom of design. This makes it possible to provide a blower wheel which is more lightweight and quieter and more efficient in operation with low manufacturing cost. Further, the blower is adaptable to any blower operating environment.

What I claim is:

1. A centrifugal blower wheel with backward curved blades comprising:

a disk, a shroud and airfoil shaped blades, wherein each of said airfoil shaped blades comprises a vane member made of non-metallic material and a vane attachment member made of sheet metal, said vane attachment member being directly fixed to said disk and said shroud so as to form a rotor, and said vane member covering said vane attachment member.

2. A centrifugal blower wheel as defined in claim 1, characterized in that said vane attachment member is provided with beads.

3. A centrifugal blower wheel as defined in claim 1, characterized in that said vane attachment member is provided with small holes.

4. A centrifugal blower wheel as defined in claim 1, wherein an outer circumference of said disk and an outer and an inner circumference of said shroud include curled beads.

5. A centrifugal blower wheel as defined in claim 1 or 4, characterized in that said vane members are made of plastic material.

6. A centrifugal blower wheel as defined in claim 1 characterized in that said vane members are made of ceramic material.

* * * * *